US009574751B1

(12) United States Patent
Eubanks et al.

(10) Patent No.: US 9,574,751 B1
(45) Date of Patent: Feb. 21, 2017

(54) FLEXIBLE LUMINAIRE

(71) Applicants: Jason Medric Eubanks, Golden, CO (US); Travis William Francis Boyle, Denver, CO (US); Brett Allan Guhde, Aurora, CO (US)

(72) Inventors: Jason Medric Eubanks, Golden, CO (US); Travis William Francis Boyle, Denver, CO (US); Brett Allan Guhde, Aurora, CO (US)

(73) Assignee: Cooper Technologies Company, Houston, TX (US)

( * ) Notice: Subject to any disclaimer, the term of this patent is extended or adjusted under 35 U.S.C. 154(b) by 58 days.

(21) Appl. No.: 14/634,494

(22) Filed: Feb. 27, 2015

(51) Int. Cl.

| | |
|---|---|
| ***F21V 17/00*** | (2006.01) |
| ***F21V 3/00*** | (2015.01) |
| ***F21S 4/00*** | (2016.01) |
| ***F21V 23/00*** | (2015.01) |
| *F21Y 101/02* | (2006.01) |
| *F21V 19/00* | (2006.01) |
| *F21V 15/01* | (2006.01) |

(52) U.S. Cl.
CPC ..... *F21V 17/00* (2013.01); *F21S 4/003* (2013.01); *F21V 3/00* (2013.01); *F21V 23/003* (2013.01); *F21V 15/01* (2013.01); *F21V 19/00* (2013.01); *F21Y 2101/02* (2013.01)

(58) Field of Classification Search
CPC ..... F21S 8/04; F21S 4/003; F21V 3/00; F21V 17/00; F21V 17/06; F21V 17/10; F21V 17/12; F21V 23/003; F21V 15/01; F21V 21/025; F21V 21/00; F21V 19/00;F21V 21/03; F21V 21/02; F21Y 2101/02
See application file for complete search history.

(56) References Cited

U.S. PATENT DOCUMENTS

| | | | | |
|---|---|---|---|---|
| 4,138,716 | A * | 2/1979 | Muhlethaler | F21S 8/06 362/260 |
| 5,716,123 | A * | 2/1998 | Lamming | F21V 3/04 362/222 |
| 8,360,620 | B1 * | 1/2013 | Rashidi | F21S 9/022 362/217.01 |
| 8,643,043 | B2 * | 2/2014 | Shimizu | F21S 8/04 257/88 |
| 2012/0069557 | A1 * | 3/2012 | Bolscher | F21V 21/025 362/217.16 |
| 2014/0268748 | A1 * | 9/2014 | Lay | F21V 15/01 362/235 |

* cited by examiner

*Primary Examiner* — Bao Q Truong
(74) *Attorney, Agent, or Firm* — King & Spalding LLP

(57) ABSTRACT

A luminaire can comprise a frame that provides a cavity for emitting illumination towards a space to be illuminated. A light source, such as a row of light emitting diodes, can emit light into the cavity. The cavity can extend lengthwise between two end caps of the frame that are located at opposing ends of the luminaire. The frame can further comprise two bridges that are located adjacent the end caps, one at each end of the frame. Two rails that extend on opposing sides of the cavity can connect the two bridges to one another. A system of grooves and protrusions can interlock the rails to the bridges. A system of standardized interchangeable components that facilitates rapid manufacture of custom luminaires can comprise the bridges, the rails, and the end caps.

18 Claims, 8 Drawing Sheets

FLEXIBLE LUMINAIRE

TECHNICAL FIELD

Embodiments of the technology relate generally to lighting solutions, and more particularly to a system of luminaire components for efficiently producing build-to-order luminaires.

BACKGROUND

Interest is growing in luminaires that can be readily customized according to customer preferences and/or made on demand. However, fabricating small lots of custom luminaires can be expensive using traditional manufacturing approaches. Conventional luminaire fabrication methodologies are generally oriented towards mass production rather than fabricating on a build-to-order basis. Accordingly, conventional manufacturing typically offers relatively poor economics for the growing trend for customization.

Accordingly, there is a need in the art for technology that can facilitate economical build-to-order luminaire production. Need also exists for technology to fabricate luminaires utilizing standardized components that can readily be cut-to-length or combined with other components that are cut-to-length. Further need exists for technology to manufacture luminaires utilizing mix-and-match components that support a wide range of product configurations. A capability addressing one or more such needs, or some other related deficiency in the art, would support improved illumination systems, for example illumination systems that are more economical, faster to manufacture, or more readily tailored to customer preferences.

SUMMARY

In one aspect of the disclosure, a frame of a lighting system can provide a cavity. A light source, for example one or more light emitting diodes, can emit light into the cavity, and the cavity can emit illumination. The frame can comprise two end caps, two bridges, and two rails. The end caps can be disposed at opposing ends of the frame. The bridges can be adjacent and between the two end caps. The rails can extend between and be interlocked with the two bridges.

In another aspect of the disclosure, the bridges, rails, and end caps can comprise elements of a system of components that can be interchanged with one another or combined in various ways to facilitate rapid manufacture of custom luminaires.

The foregoing discussion of lighting systems is for illustrative purposes only. Various aspects of the present technology may be more clearly understood and appreciated from a review of the following text and by reference to the associated drawings and the claims that follow. Other aspects, systems, methods, features, advantages, and objects of the present technology will become apparent to one with skill in the art upon examination of the following drawings and text. It is intended that all such aspects, systems, methods, features, advantages, and objects are to be included within this description and covered by this application and by the appended claims of the application.

Figure 1A:
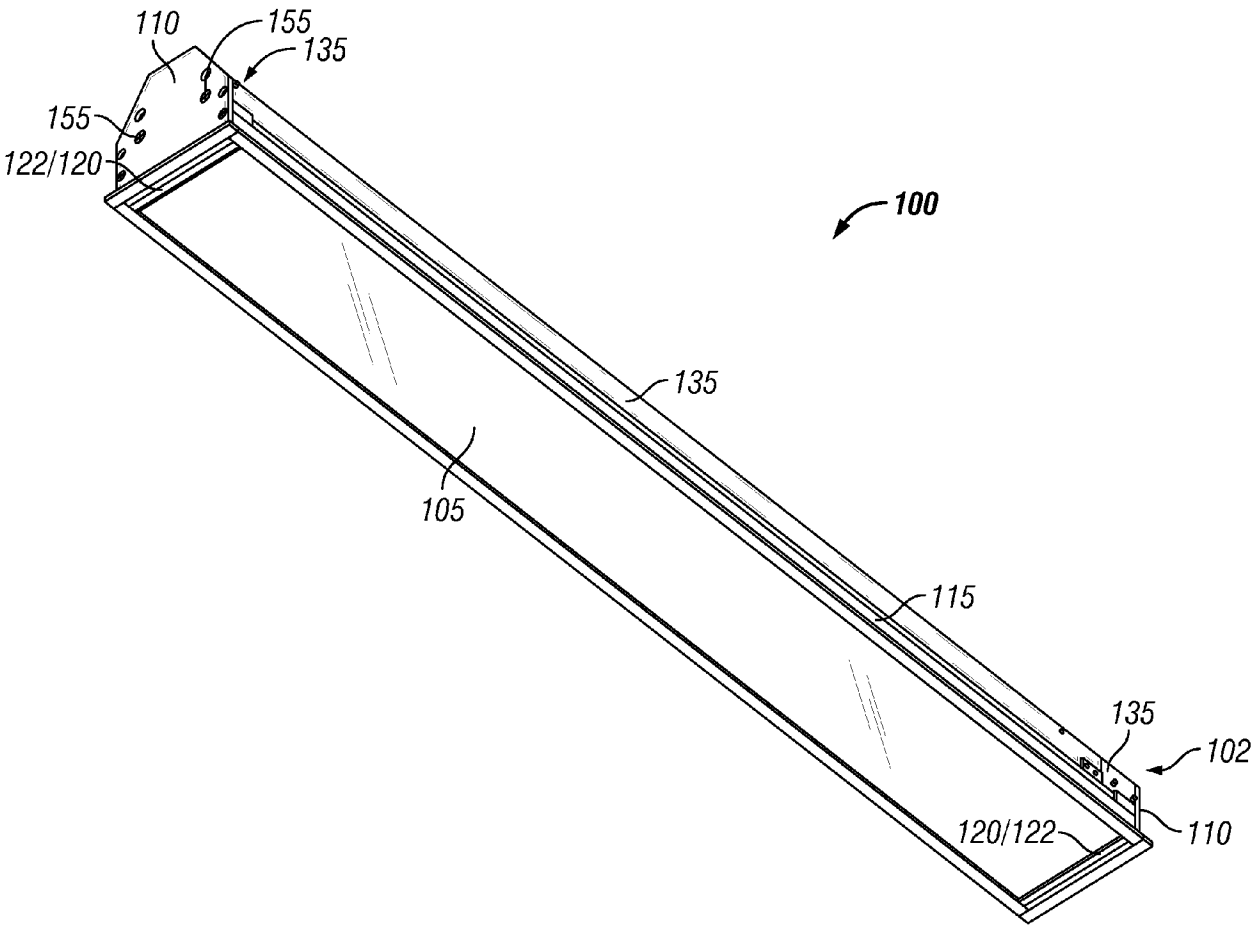
FIGS. 1A and 1B (collectively FIG. 1) respectively illustrate perspective views of lower and upper sides of a luminaire according to some example embodiments of the present disclosure.

The drawings illustrate only example embodiments and are therefore not to be considered limiting of the embodiments described, as other equally effective embodiments are within the scope and spirit of this disclosure. The elements and features shown in the drawings are not necessarily drawn to scale, emphasis instead being placed upon clearly illustrating principles of the embodiments. Additionally, certain dimensions or positionings may be exaggerated to help visually convey certain principles. In the drawings, similar reference numerals among different figures designate like or corresponding, but not necessarily identical, elements.

DESCRIPTION OF EXAMPLE EMBODIMENTS

A luminaire can comprise items selected from a system of components that can be combined in different ways to make different luminaires, for example in connection with efficiently fulfilling short-run or custom orders.

The present technology can be embodied in many different forms and should not be construed as limited to the embodiments set forth herein; rather, these embodiments are provided so that this disclosure will be thorough and complete, and will fully convey the scope of the technology to those having ordinary skill in the art. Furthermore, all "examples," "embodiments," "example embodiments," or "exemplary embodiments" given herein are intended to be non-limiting and among others supported by representations of the present technology.

Figure 7:
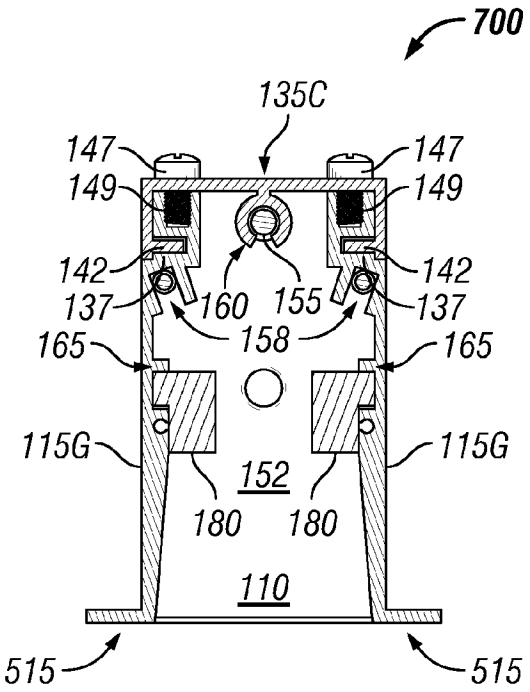
FIG. 7 illustrates a perspective view of a lateral cross section of another luminaire frame according to some example embodiments of the present disclosure.

Lighting systems will now be described more fully with reference to FIGS. 1-7, which describe representative embodiments of the present disclosure. FIGS. 1, 2, and 3 illustrate an embodiment of a luminaire. FIGS. 4 and 5 illustrate luminaire components that can be used to create different luminaire configurations. FIGS. 6 and 7 illustrate two such configurations.

Figure 1B:
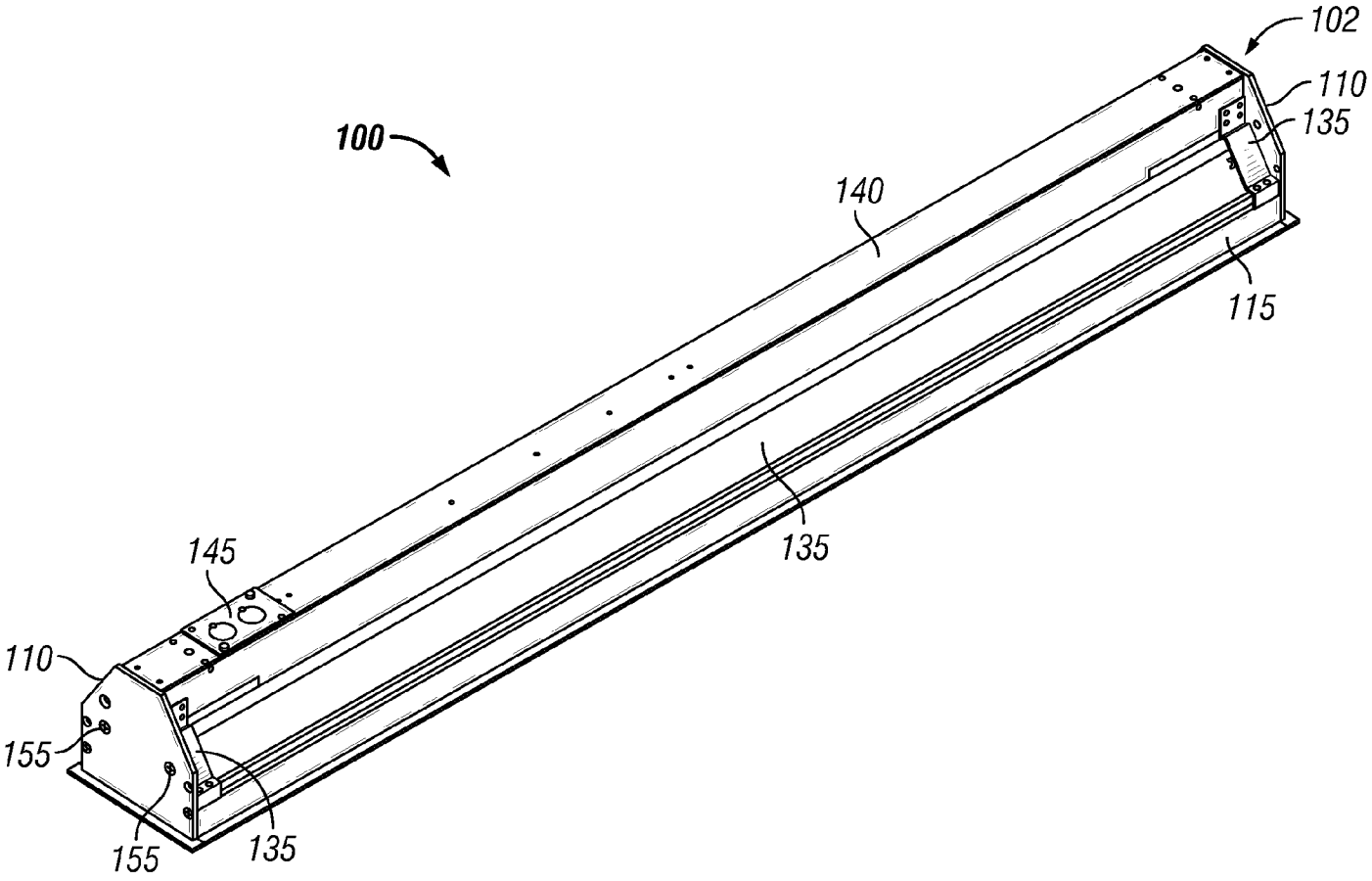
Figure 2:
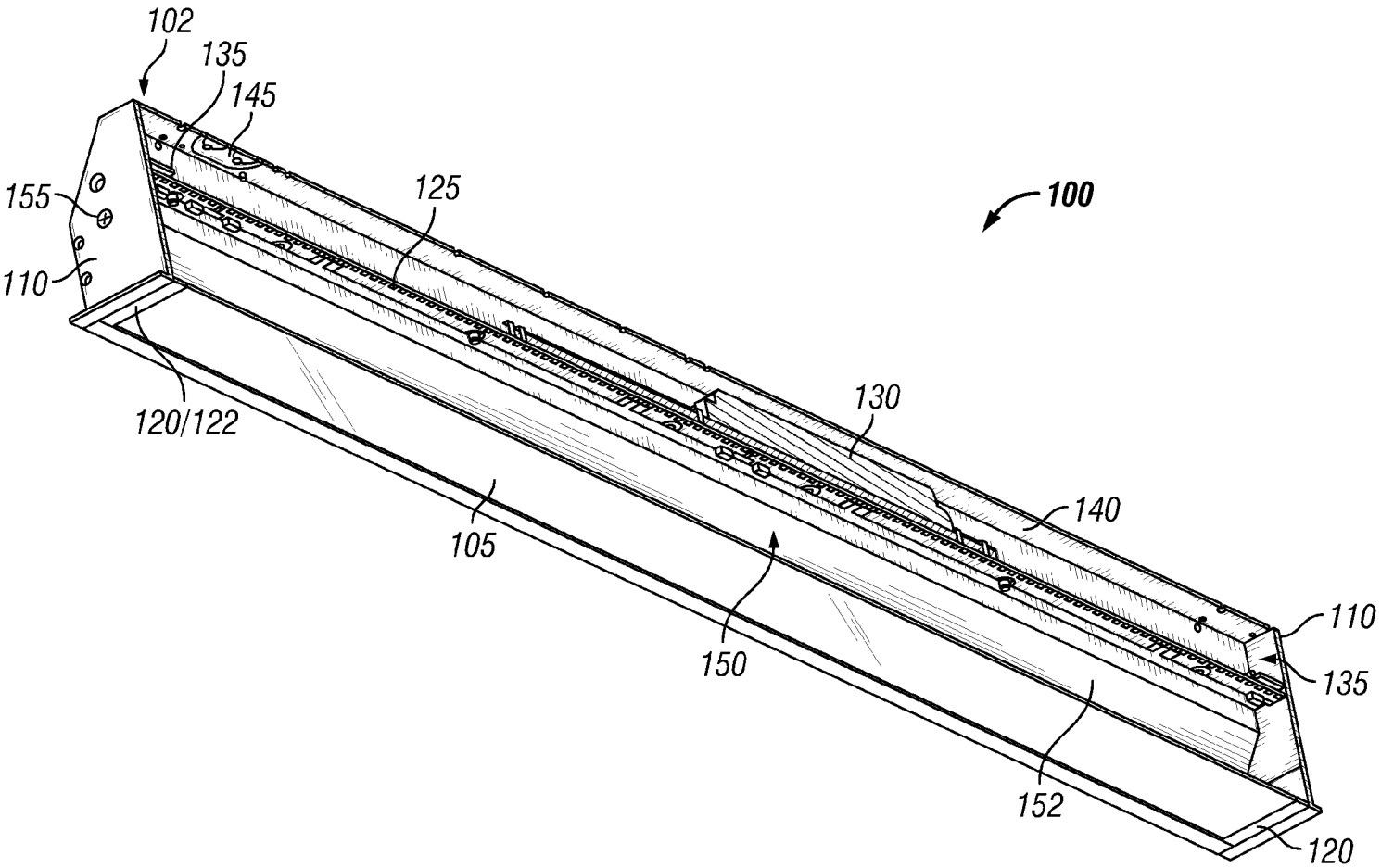
FIG. 2 illustrates a perspective view of a lengthwise cross section of the luminaire according to some example embodiments of the present disclosure.
Figure 3:
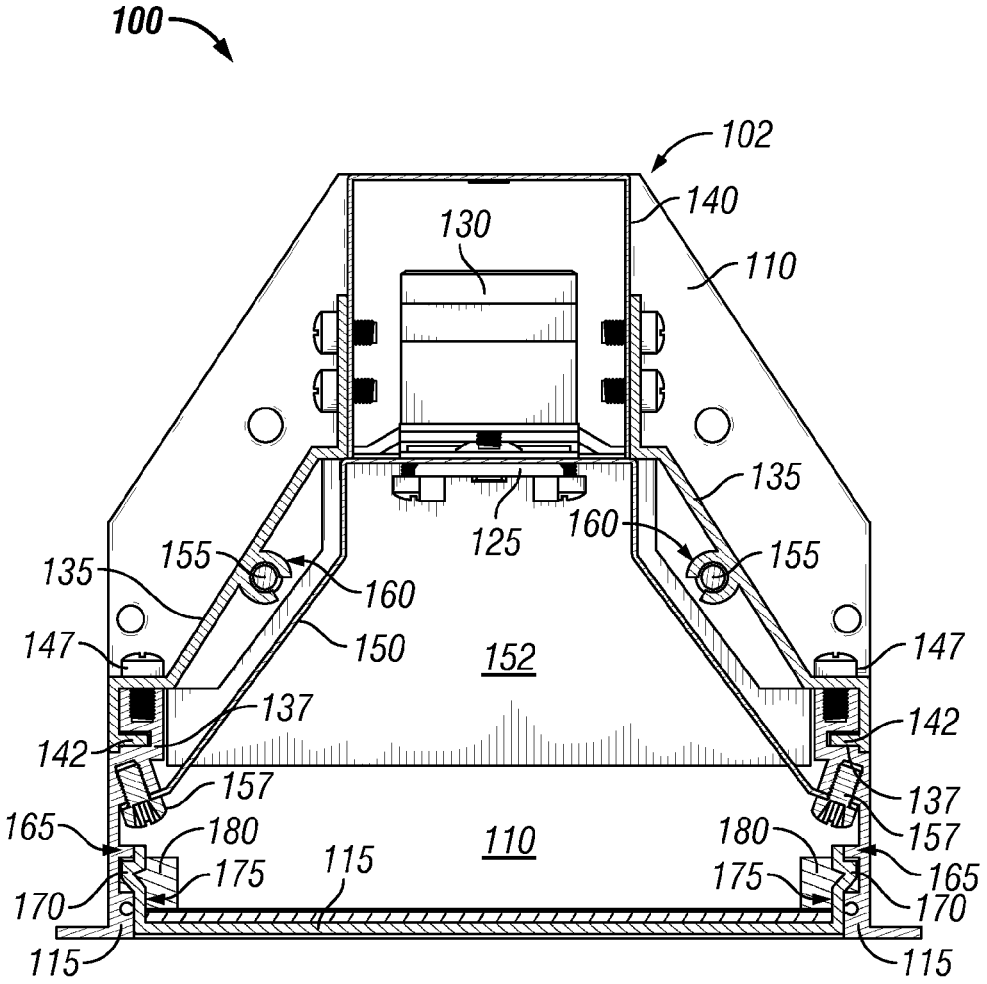
FIG. 3 illustrates a perspective view of a lateral cross section of the luminaire according to some example embodiments of the present disclosure.

Turning now to FIGS. 1, 2, and 3, some example embodiments of the disclosure will be discussed. FIGS. 1A and 1B respectively illustrate perspective views of lower and upper sides of a luminaire 100. FIG. 2 illustrates a perspective view of a lengthwise cross section of the luminaire 100. FIG. 3 illustrates a perspective view of a lateral cross section of the luminaire 100, taken perpendicular to the view of FIG. 2.

In some example embodiments, the luminaire 100 can be mounted overhead, for example recessed in a ceiling. In some example embodiments, the luminaire 100 can be mounted along an edge of a ceiling, such as recessed in the ceiling near where the ceiling adjoins a wall. Various embodiments are applicable to a wide range of indoor and outdoor applications.

In the illustrated example embodiment, the luminaire 100 is elongate, or long and narrow. In some embodiments, the luminaire 100 can have a customizable length, for example in a range of 2 feet to 12 feet. When a manufacturer receives an order for one or more of the luminaires 100, the manufacturer can produce units of a requested length utilizing standardized components that may be readily cut-to-length.

The illustrated example luminaire 100 comprises a frame 102 that provides structural support and facilitates mounting and housing of various luminaire elements. The frame 102 comprises two rails 115 that extend between two end caps 110.

Luminaires 100 of arbitrary length may be fabricated by cutting segments of rail 115 to a custom length while using a universal end cap design. In some example embodiments, the rails 115 are composed of aluminum or other suitable metallic material. In some embodiments, the rails 115 are formed of acrylic or other suitable plastic/polymer material. In some embodiments, the rails 115 are formed of like material to the optic 105, which is discussed in further detail below. Accordingly, the rails 115 and the optic 105 may have similar or common optical properties, including in some embodiments a capability to diffuse light. In some embodiments, the rails 115 are formed of a composite, such as fiberglass.

The illustrated example luminaire 100 further comprises two bridges 135, one adjacent each end cap 110. The bridges 135 can be formed of a metal, such as aluminum, or of an appropriate polymer or composite material. In some embodiments, the bridges 135 may adjoin the end caps 110. In some embodiments, the bridges 135 may be adjacent the end caps 110. In some embodiments, the bridges 135 may abut or touch the end caps 110. In some embodiments, the bridges 135 may be near but separated from the end caps 110.

In some embodiments, more than two bridges 135 may be incorporated into a single luminaire. For example, a long luminaire may utilize a third bridge 135 near the luminaire center. In some luminaire embodiments, more than three bridges 135 may be incorporated, for example so they are spaced substantially equal distances from one another.

As best seen on FIG. 3, each bridge 135 comprises two snap-in channels 160 that are sized to receive fastening rods 155. The fastening rods 155 span the length of the luminaire 100 and attach to the end caps 110. The fastening rods 155 can be formed or cut to custom lengths corresponding to the custom rail lengths discussed above. The fastening rods 155 can be formed of metal, composite, fiberglass, or other appropriate materials.

In some example embodiments, the ends of the fastening rods 155 are threaded with male threads that may screw into corresponding threaded holes in the end caps 110. In some embodiments, the ends of the fastening rods 155 have male threads that fasten to corresponding nuts at the end caps 110. In some embodiments, the fastening rods 155 are threaded along their entire lengths rather than only at their ends.

In some embodiments, the ends of the fastening rods 155 are drilled and tapped with female threads. In such embodiments, the fastening rods 155 may be attached to the end caps using screws that screw into the resulting threaded holes at the ends of the fastening rods 155.

As best seen in the cross sectional view of FIG. 3, each rail 115 mates with the bridge 135 in an interlocking arrangement that enhances structural integrity. In the illustrated embodiment, the bridge 135 comprises grooves 137 that extend lengthwise. The rails 115 comprise corresponding protrusions 142 that seat in and mate with the grooves 137. In some other example embodiments, the rails 115 comprise the grooves 137, and the bridge 135 comprises the interlocking protrusions 142. Fasteners 147, which comprise screws in the illustrated embodiment, firmly attach the rails 115 to the bridges 135. Joined together as shown in FIG. 3, the rails 115, bridge 135, and other luminaire structures form a cavity 152 from which light exits into a space to be illuminated.

The illustrated example luminaire 100 further comprises a tray 150, which may be formed from a thin sheet of aluminum or polymer or other appropriate material. The tray 150 may be cut to a custom length according to a customer's specified luminaire length, for example. In the illustrated embodiment, fasteners 157, specifically screws in this embodiment, attach the tray 150 to the rails 115.

The tray 150 can be reflective so that light incident upon the tray surface is reflected out of the luminaire 100 towards a space to be illuminated. Such reflectivity can be specular in some embodiments or diffuse reflectivity in others. The diffuse reflectivity can be due to a metallic surface pattern or a diffusely reflective paint or other appropriate coating. The tray 150 can line at least a portion of the cavity 152, for example.

In the illustrated example embodiment, the upper side of the luminaire 100 comprises a hood 140 that forms an enclosure to house electrical elements of the luminaire 100. The hood 140 extends between and attaches to the bridges 135, so that the resulting electrical enclosure extends longitudinally along the luminaire 100 above the cavity 152.

As best seen in FIGS. 1B and 2, the example hood 140 comprises a wiring port 145 through which electrical supply lines pass to feed electricity to the luminaire 100. As illustrated, the wiring port 145 comprises a plate that is mounted to the hood 140. In some other embodiments, the wiring port 145 can be formed directly in the hood 140 or in some other suitable part of the luminaire 100.

As visible in the cross sectional views of FIGS. 2 and 3, the hood 140 encloses a light emitting diode (LED) driver 130. The example hood 140 further encloses supporting electrical elements. Such electrical elements may include wiring that couples to an electrical supply line, which an installer can pass through the wiring port 145 during installation of the luminaire 100.

The light emitting diode driver 130 supplies electricity to a row of light emitting diodes 125 that extends lengthwise within a ceiling of the cavity 152 as illustrated in FIGS. 2 and 3. In some embodiments, the light emitting diodes 125 comprise modules that may comprise banks of light emitting diodes 125, for example. Using modular light emitting diodes 125 can facilitate fabrication of luminaires 100 that are build-to-order according to customer length preference. For example, if a customer places an order for a luminaire of a custom length, an appropriate number of light emitting diode modules can be readily mounted during fabrication to meet the customer's specific needs.

In operation, the light emitting diodes 125 emit light into the cavity 152. The light exits the cavity 152 through the optic 105, positioned at the cavity aperture, to provide illumination for an area, such a room or hallway for example. In the illustrated embodiment, the optic 105 can comprise a diffuser that softens and diffuses the illumination. The optic 105 can comprise a sheet of acrylic or other suitable optical material, for example. In some embodiments, the surface of the optic 105 can be patterned with features that diffuse transmitting light via refraction, for example microlenses or relief structures. In some embodiments, the optic 105 is loaded with scattering material that diffuses light as the light transmits through the optic 105. The scattering material may be homogenously distributed within the optic 105 or preferentially oriented to an inner or outer side of the optic 105, for example. The optic 105 can be translucent, colored, or clear in various example embodiments.

As shown in FIG. 3, the example optic 115 is formed to provide a flat lower surface through which light passes and two sides 175 that are bent up, to provide a cross section having a U-shaped geometry. Each side 175 of the optic 105 comprises a protrusion 170 that extends lengthwise between opposing ends of the luminaire 100. The protrusions 170 seat in grooves 165 of the rails 115 that face inward, towards the cavity 152. In an example embodiment, the protrusions 170 of the optic 105 can readily snap into and out of the grooves 165. Accordingly, personnel can readily take the optic 105 on and off of the luminaire 100 in connection with accessing and closing the cavity 152 for service, installation, or other appropriate activity. The protrusion-and-groove arrangement further allows the optic 105 and the frame 102 to lengthen and shorten without undue stress as temperature changes. That is, the rails 115 and the optic 105 can expand and contract lengthwise without binding. The arrangement thus facilitates thermal expansion and contraction of the various luminaire elements.

In an example embodiment, the optic 105 comprises two edges located at opposing ends of the luminaire 100. An expansion gap can separate each optic edge from the adjacent end cap 110 and provide space for the optic 105 to expand and contract relative to the frame 102 of the luminaire 100 over temperature fluctuations.

A removable cover 120 that comprises a lip 122 can be situated below the edge of the optic 105. Thus, the lip 122 can overlap and cover the edge of the optic 105. In some example embodiments, the removable cover 120 is opaque and serves to block light from exiting the luminaire 100 through the expansion gap. The removable cover 120 may further obscure the edge of the optic 105 from view by an observer. The removable cover 120 may further provide personnel with ready access to the edge of the optic 105. For example, a person seeking to service the luminaire 100 may remove the removable cover 120 and then grasp the edge to facilitate removal of the optic 105 as discussed above.

In some embodiments, the removable cover 120 is made of acrylic or other material through which light can pass. In some embodiments, the removable cover 120 is formed of the same material as the optic 105. Thus, the removable cover 120 may exhibit like optical properties and function to the optic 105, discussed above.

The removable cover 120 can magnetically attached to the frame 102 of the luminaire 100. More specifically, the removable cover 120 can attach to the end cap 110 of the luminaire 100 via a magnet and a ferrous tape 180. The ferrous tape 180 can provide the end cap 110 with a magnetically active material so that the magnet can hold to the end cap 110 using magnetic force even if the end cap 110 is otherwise made of acrylic, aluminum, or other material that is not magnetically inactive. In various example embodiments, the ferrous tape 180 can be attached to the end cap 110 using screws, rivets, fasteners, glues, adhesives, solder, or some other appropriate fastening technology.

In some embodiments, a thick rigid member made of iron or other magnetically active material is incorporated for the function of the ferrous tape 180. In some example embodiments, at least a portion of the end cap 110 is inset with or otherwise comprises a section of iron or other magnetically active material.

In various embodiments, the magnet can be attached to the removable cover 120 via press fit, glue, bonding agents, rivets, screws, or other appropriate attachment technology. In one example embodiment, the magnet is made of the material known in the trade under the specification "N42SH," which is commercially available from multiple sources.

Turning now to FIGS. 4 and 5, some additional bridge and rail embodiments will be discussed in accordance with further examples of the disclosure. FIGS. 4A, 4B, 4C, 4D, and 4E illustrate perspective views of five example bridge embodiments. FIGS. 5A, 5B, 5C, 5D, 5E, 5F, 5G, 5H, 5I, and 5J illustrate cross sectional views of ten example rail embodiments.

Figure 4B:
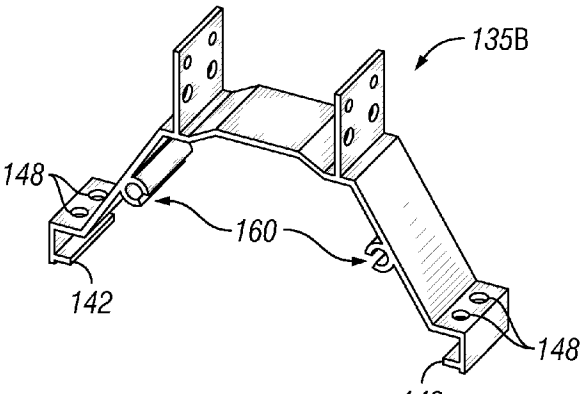
FIGS. 4A, 4B, 4C, 4D, and 4E (collectively FIG. 4) illustrate perspective views of five luminaire bridges according to some example embodiments of the present disclosure.
Figure 4A:
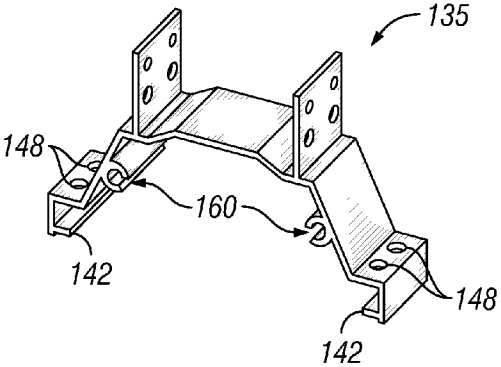

FIG. 4A illustrates a perspective view of the bridge 135 that is incorporated in the luminaire 100 as discussed above. As illustrated in FIG. 3, the bridge 135 extends over the cavity 152 of the luminaire 100.

FIG. 4B illustrates a perspective view of another example embodiment of a bridge 135B that can extend over a cavity 152 when incorporated in a luminaire. The bridge 135B comprises lengthwise extending protrusions 142 and snap-in channels 160 that are dimensioned according to the corresponding protrusions 142 and snap-in channels 160 of the bridge 135. Accordingly, the bridges 135B and 135 are compatible and interchangeable with one another. Moreover, the bridge 135B is compatible and interchangeable with other bridges, including the example bridges 135C, 135D, and 135E illustrated in FIG. 4.

Figure 4E:
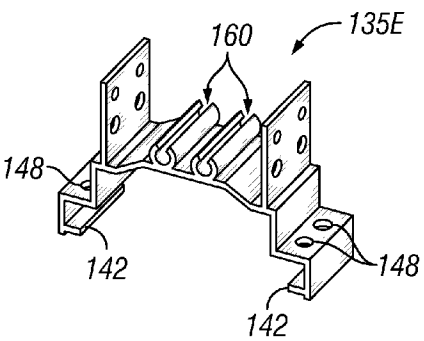
Figure 4D:
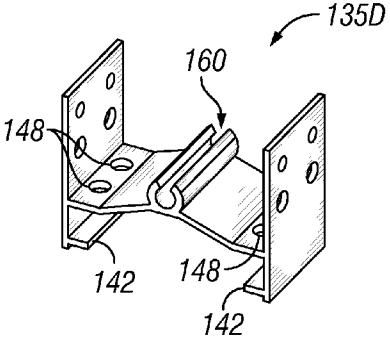
Figure 4C:
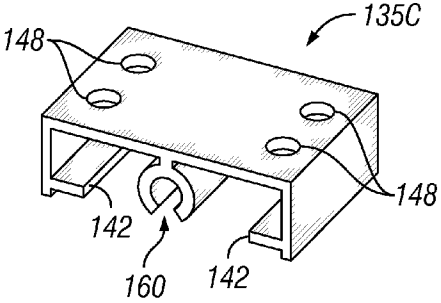

FIG. 4C illustrates a perspective view of another example embodiment of a bridge 135C that can extend over a cavity 152 when incorporated in a luminaire. The bridge 135C comprises lengthwise extending protrusions 142 and snap-in channels 160 that are dimensioned according to the corresponding protrusions 142 and snap-in channels 160 of the bridge 135. Accordingly, the bridges 135C and 135 are compatible and interchangeable with one another. Moreover, the bridge 135C is compatible and interchangeable with other bridges, including the example bridges 135B, 135D, and 135E illustrated in FIG. 4.

FIG. 4D illustrates a perspective view of another example embodiment of a bridge 135D that can extend over a cavity 152 when incorporated in a luminaire. The bridge 135D comprises lengthwise extending protrusions 142 and snap-in channels 160 that are dimensioned according to the corresponding protrusions 142 and snap-in channels 160 of the bridge 135. Accordingly, the bridges 135D and 135 are compatible and interchangeable with one another. Moreover, the bridge 135D is compatible and interchangeable with other bridges, including the example bridges 135B, 135C, and 135E illustrated in FIG. 4.

FIG. 4E illustrates a perspective view of another example embodiment of a bridge 135E that can extend over a cavity 152 when incorporated in a luminaire. The bridge 135E comprises lengthwise extending protrusions 142 and snap-in channels 160 that are dimensioned according to the corresponding protrusions 142 and snap-in channels 160 of the bridge 135. Accordingly, the bridges 135E and 135 are compatible and interchangeable with one another. Moreover, the bridge 135E is compatible and interchangeable with other bridges, including the example bridges 135B, 135C, and 135D illustrated in FIG. 4.

Turning now to FIG. 5 example rail embodiments will be discussed in further detail. FIG. 5A illustrates a cross sectional view of the rail 115 that is incorporated in the luminaire 100 as discussed above. As illustrated in FIG. 3, two of the rails 115 extend lengthwise along opposing sides of the cavity 152 of the luminaire 100 and interlock with the bridge 135. As illustrated in FIG. 5A, the rail 115 comprises: a receptacle 149 for a fastener 147 that fastens the rail 115B to the bridge 135 or to the bridges 135B, 135C, 135D, 135E; another receptacle 158 for a fastener 157 that attaches the tray 150; and another lengthwise extending groove 165 that receives a corresponding lengthwise extending protrusion 170 of the optic 105.

Figures 5A, 5B, 5C, 5D, 5E:
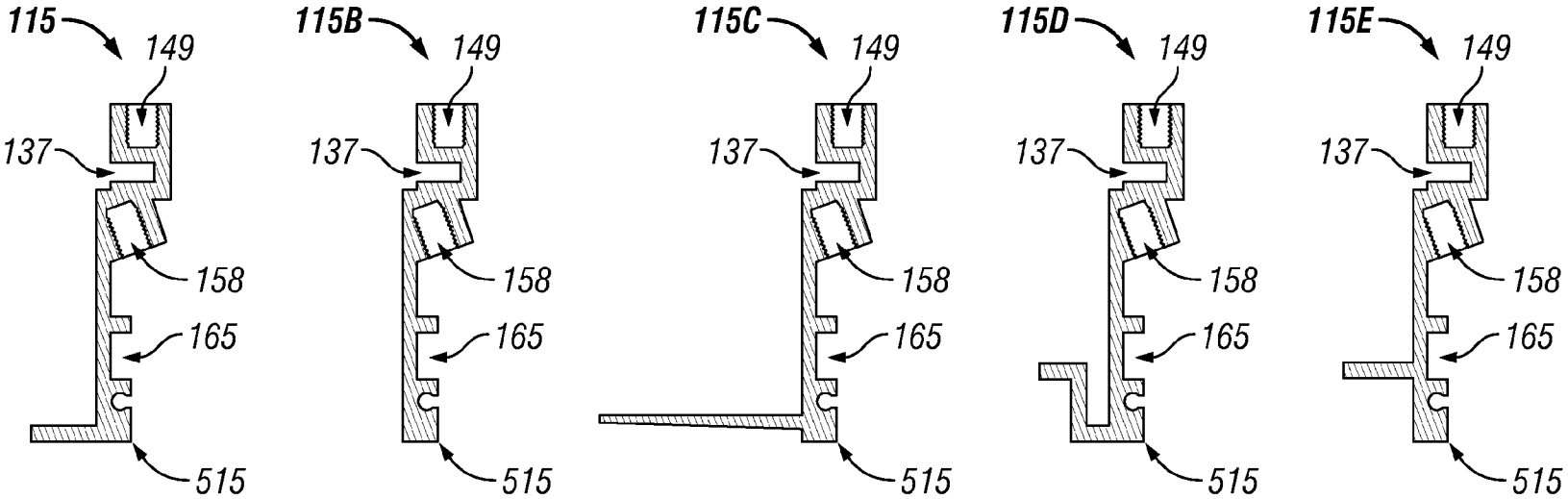
FIGS. 5A, 5B, 5C, 5D, 5E, 5F, 5G, 5H, 5I, and 5J (collectively FIG. 5) illustrate cross sectional views of ten luminaire rails according to some example embodiments of the present disclosure.

FIG. 5B illustrates a cross sectional view of another example embodiment of a rail 115B that can extend along a luminaire cavity 152 as part of a luminaire frame 102. The rail 115B comprises: a lengthwise extending groove 137 that interlocks with a corresponding lengthwise extending protrusion 142 of a bridge 135, 135B, 135C, 135D, 135E; a receptacle 149 for a fastener 147 that fastens the rail 115B to a bridge 135, 135B, 135C, 135D, 135E; another receptacle 158 for a fastener 157 that attaches the tray 150; and another lengthwise extending groove 165 that receives a corresponding lengthwise extending protrusion 170 of the optic 105. The rail 115B is compatible and interchangeable with other rails, including the example rails 115, 115C, 115D, 115E, 115F, 115G, 115H, 115I, and 115J illustrated in FIG. 5.

FIG. 5C illustrates a cross sectional view of another example embodiment of a rail 115C that can extend along a luminaire cavity 152 as part of a luminaire frame 102. The rail 115C comprises: a lengthwise extending groove 137 that interlocks with a corresponding lengthwise extending protrusion 142 of a bridge 135, 135B, 135C, 135D, 135E; a receptacle 149 for a fastener 147 that fastens the rail 115C to a bridge 135, 135B, 135C, 135D, 135E; another receptacle 158 for a fastener 157 that attaches the tray 150; and another lengthwise extending groove 165 that receives a corresponding lengthwise extending protrusion 170 of the optic 105. The rail 115C is compatible and interchangeable with other rails, including the example rails 115, 115B, 115D, 115E, 115F, 115G, 115H, 115I, and 115J illustrated in FIG. 5.

FIG. 5D illustrates a cross sectional view of another example embodiment of a rail 115D that can extend along a luminaire cavity 152 as part of a luminaire frame 102. The rail 115D comprises: a lengthwise extending groove 137 that interlocks with a corresponding lengthwise extending protrusion 142 of a bridge 135, 135B, 135C, 135D, 135E; a receptacle 149 for a fastener 147 that fastens the rail 115D to a bridge 135, 135B, 135C, 135D, 135E; another receptacle 158 for a fastener 157 that attaches the tray 150; and another lengthwise extending groove 165 that receives a corresponding lengthwise extending protrusion 170 of the optic 105. The rail 115D is compatible and interchangeable with other rails, including the example rails 115, 115B, 115C, 115E, 115F, 115G, 115H, 115I, and 115J illustrated in FIG. 5.

FIG. 5E illustrates a cross sectional view of another example embodiment of a rail 115E that can extend along a luminaire cavity 152 as part of a luminaire frame 102. The rail 115E comprises: a lengthwise extending groove 137 that interlocks with a corresponding lengthwise extending protrusion 142 of a bridge 135, 135B, 135C, 135D, 135E; a receptacle 149 for a fastener 147 that fastens the rail 115E to a bridge 135, 135B, 135C, 135D, 135E; another receptacle 158 for a fastener 157 that attaches the tray 150; and another lengthwise extending groove 165 that receives a corresponding lengthwise extending protrusion 170 of the optic 105. The rail 115E is compatible and interchangeable with other rails, including the example rails 115, 115B, 115C, 115D, 115F, 115G, 115H, 115I, and 115J illustrated in FIG. 5.

Figure 5J:
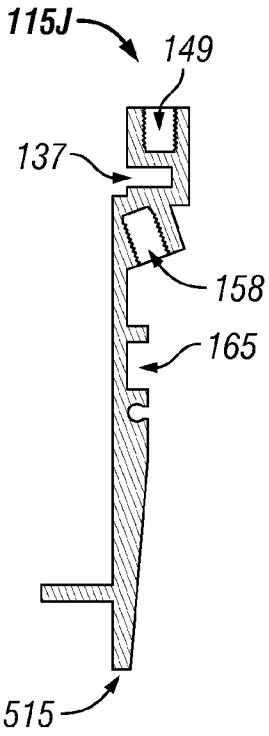
Figure 5I:
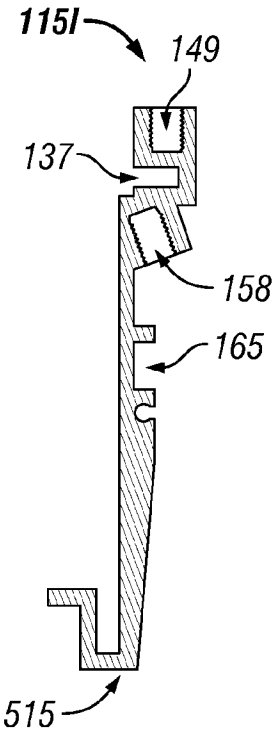
Figure 5H:
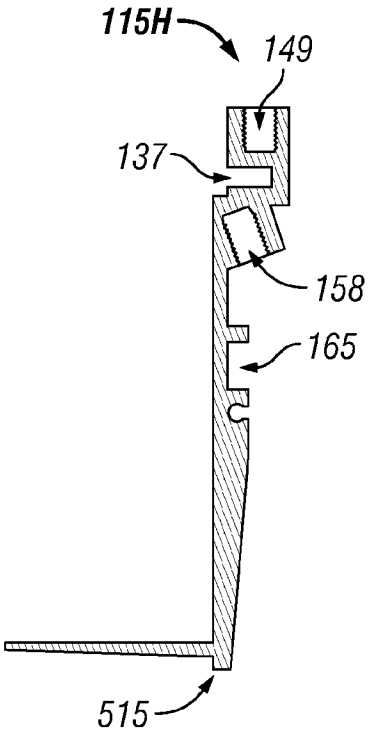
Figure 5G:
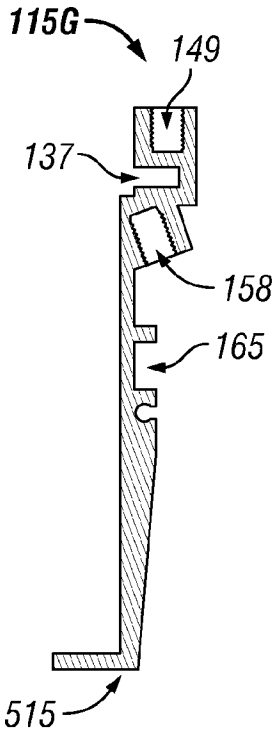
Figure 5F:
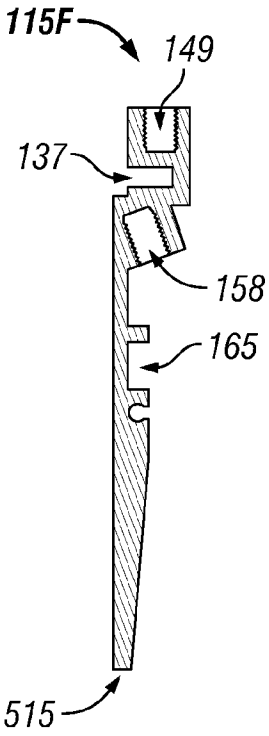
Figure 6:
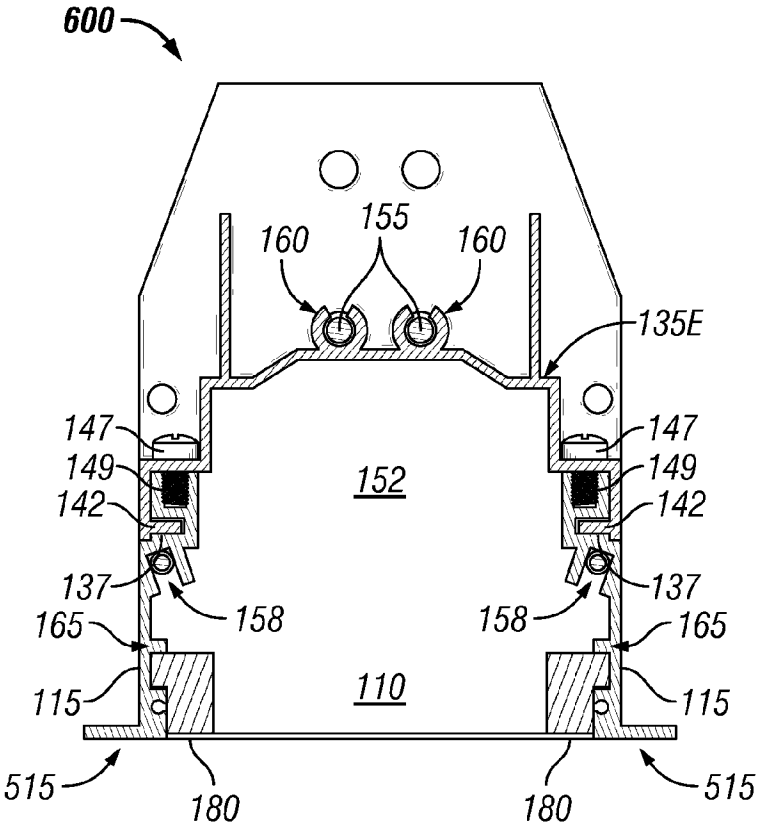
FIG. 6 illustrates a perspective view of a lateral cross section of a luminaire frame according to some example embodiments of the present disclosure.

FIG. 5F illustrates a cross sectional view of another example embodiment of a rail 115F that can extend along a luminaire cavity 152 as part of a luminaire frame 102. The rail 115F comprises: a lengthwise extending groove 137 that interlocks with a corresponding lengthwise extending protrusion 142 of a bridge 135, 135B, 135C, 135D, 135E; a receptacle 149 for a fastener 147 that fastens the rail 115F to a bridge 135, 135B, 135C, 135D, 135E; another receptacle 158 for a fastener 157 that attaches the tray 150; and another lengthwise extending groove 165 that receives a corresponding lengthwise extending protrusion 170 of the optic 105. The rail 115F is compatible and interchangeable with other rails, including the example rails 115, 115B, 115C, 115D, 115E, 115G, 115H, 115I, and 115J illustrated in FIG. 5.

FIG. 5G illustrates a cross sectional view of another example embodiment of a rail 115G that can extend along a luminaire cavity 152 as part of a luminaire frame 102. The rail 115G comprises: a lengthwise extending groove 137 that interlocks with a corresponding lengthwise extending protrusion 142 of a bridge 135, 135B, 135C, 135D, 135E; a receptacle 149 for a fastener 147 that fastens the rail 115G to a bridge 135, 135B, 135C, 135D, 135E; another receptacle 158 for a fastener 157 that attaches the tray 150; and another lengthwise extending groove 165 that receives a corresponding lengthwise extending protrusion 170 of the optic 105. The rail 115G is compatible and interchangeable with other rails, including the example rails 115, 115B, 115C, 115D, 115E, 115F, 115H, 115I, and 115J illustrated in FIG. 5.

FIG. 5H illustrates a cross sectional view of another example embodiment of a rail 115H that can extend along a luminaire cavity 152 as part of a luminaire frame 102. The rail 115H comprises: a lengthwise extending groove 137 that interlocks with a corresponding lengthwise extending protrusion 142 of a bridge 135, 135B, 135C, 135D, 135E; a receptacle 149 for a fastener 147 that fastens the rail 115H to a bridge 135, 135B, 135C, 135D, 135E; another receptacle 158 for a fastener 157 that attaches the tray 150; and another lengthwise extending groove 165 that receives a corresponding lengthwise extending protrusion 170 of the optic 105. The rail 115H is compatible and interchangeable with other rails, including the example rails 115, 115B, 115C, 115D, 115E, 115F, 115G, 115I, and 115J illustrated in FIG. 5.

FIG. 5I illustrates a cross sectional view of another example embodiment of a rail 115I that can extend along a luminaire cavity 152 as part of a luminaire frame 102. The rail 115I comprises: a lengthwise extending groove 137 that interlocks with a corresponding lengthwise extending protrusion 142 of a bridge 135, 135B, 135C, 135D, 135E; a receptacle 149 for a fastener 147 that fastens the rail 115I to a bridge 135, 135B, 135C, 135D, 135E; another receptacle 158 for a fastener 157 that attaches the tray 150; and another lengthwise extending groove 165 that receives a corresponding lengthwise extending protrusion 170 of the optic 105. The rail 115I is compatible and interchangeable with other rails, including the example rails 115, 115B, 115C, 115D, 115E, 115F, 115G, 115H, and 115J illustrated in FIG. 5.

FIG. 5J illustrates a cross sectional view of another example embodiment of a rail 115J that can extend along a luminaire cavity 152 as part of a luminaire frame 102. The rail 115J comprises: a lengthwise extending groove 137 that interlocks with a corresponding lengthwise extending protrusion 142 of a bridge 135, 135B, 135C, 135D, 135E; a receptacle 149 for a fastener 147 that fastens the rail 115J to a bridge 135, 135B, 135C, 135D, 135E; another receptacle 158 for a fastener 157 that attaches the tray 150; and another lengthwise extending groove 165 that receives a corresponding lengthwise extending protrusion 170 of the optic 105. The rail 115J is compatible and interchangeable with other rails, including the example rails 115, 115B, 115C, 115D, 115E, 115F, 115G, 115H, and 115I illustrated in FIG. 5.

As discussed above, the example bridges 135, 135B, 135C, 135D, and 135E illustrated in FIG. 4 have different geometries but common features that support interchangeability with one another and compatibility with other luminaire elements. Similarly, the example rails 115, 115B, 115C, 115D, 115E, 115F, 115G, 115H, 115I, and 115J illustrated in FIG. 5 have different geometries but common features that support interchangeability with one another and compatibility with other luminaire elements. The bridges 135, 135B, 135C, 135D, and 135E and the rails 115, 115B, 115C, 115D, 115E, 115F, 115G, 115H, 115I, and 115J can thus be combined with one another to create a wide range of luminaire configurations. The different bridge configurations and sizes and the different rail geometries support numerous custom luminaire configurations as may be desired for different customer applications and installations. For example, the lower portions 515 of the rails 115, 115B, 115C, 115D, 115E, 115F, 115G, 115H, 115I, and 115J can have different configurations for diverse mounting styles with different ceilings and other structures.

Accordingly, the illustrated bridges 135, 135B, 135C, 135D, and 135E; the illustrated rails 115, 115B, 115C, 115D, 115E, 115F, 115G, 115H, 115I, and 115J; and the other elements of the illustrated luminaire 100 represent example components of a system of standardized interchangeable components that facilitates rapid, build-to-order manufacture of custom luminaires. FIGS. 6 and 7 illustrate lateral cross sectional views of two luminaire frames 600 and 700 that can be created using the mix-and-match capabilities of such a system of standardized interchangeable luminaire components.

The example luminaire frame 600 illustrated in FIG. 6 comprises the bridge 135E combined with two of the rails 115. The example luminaire frame 700 illustrated in FIG. 7 comprises the bridge 135C combined with two of the rails 115G.

Each of the illustrated frames 600 and 700 illustrated in FIGS. 6 and 7 further comprises components and elements corresponding to those of the luminaire 100 discussed above. More specifically, consistent with the foregoing discussion, each of the example frames 600, 700 comprises: lower rail portions 515 for luminaire installation; a cavity 152 that emits illumination; lengthwise extending grooves 137 and associated lengthwise extending protrusions 142 for bridge-to-rail interlock; receptacles 149 and associated fasteners 147 for rail-to-bridge attachment; fastener receptacles 158 for tray attachment; lengthwise extending grooves 165 for optic attachment; at least one fastening rod 155 and associated snap-in channel 160; and end caps 110 that have associated ferrous tape 180 (one end cap 110 visible at rear of cross section view).

Illumination technology has been described. From the description, it will be appreciated that embodiments of the present technology overcome limitations of the prior art. Those skilled in the art will appreciate that the present technology is not limited to any specifically discussed application or implementation and that the embodiments described herein are illustrative and not restrictive. From the description of the example embodiments, equivalents of the elements shown therein will suggest themselves to those skilled in the art, and ways of constructing other embodiments of the present technology will appear to practitioners of the art.

What is claimed is:

1. A lighting fixture comprising:

a frame comprising:

a cavity extending lengthwise between opposing ends of the lighting fixture, the cavity comprising:

an upper portion;

a lower portion; and an aperture disposed at the lower portion;

two first members that extend lengthwise along opposing sides of the cavity, each first member comprising a groove that faces away from the cavity;

two second members extending over the cavity at opposing ends of the cavity, each second member comprising a protrusion that faces the cavity and that is disposed in one of the grooves in an interlocking relationship; and a plurality of fasteners that fasten the two first members to the two second members;

a light source disposed in the upper portion of the cavity; and an optic disposed adjacent the aperture.

2. The lighting fixture of claim 1, wherein each second member further comprises at least one channel, and wherein the frame further comprises at least one rod that extends lengthwise along the cavity and that is disposed in the respective channels of the two second members.

3. The lighting fixture of claim 1, wherein the light source comprises a plurality of light emitting diodes.

4. The lighting fixture of claim 1, wherein the optic comprises a diffuser.

5. A luminaire comprising:

an elongate cavity configured to emit illumination; and a frame that extends lengthwise adjacent the elongate cavity, between a first end and a second end of the luminaire, the frame comprising:

a first member disposed at the first end of the luminaire at least partially above the cavity;

a second member disposed at the second end of the luminaire at least partially above the cavity;

a third member that extends between the first member and the second member; and a fourth member that extends between the first member and the second member, wherein lengthwise extending protrusions and lengthwise extending grooves interlock the third member with the first and second members and interlock the fourth member with the first and second members, and wherein a plurality of fasteners fasten the third member to the first member and the second member and fasten the fourth member to the first member and the second member.

6. The luminaire of claim 5, wherein the first member and the second member comprise the lengthwise extending protrusions, and wherein the third member and the fourth member comprise the lengthwise extending grooves.

7. The luminaire of claim 5, wherein the first member and the second member comprise two bridges, and wherein the third member and the fourth member comprise two rails.

8. The luminaire of claim 5, wherein the first member further comprises a first channel, wherein the second member further comprises a second channel, and wherein the frame further comprises:

a first end cap disposed at the first end of the luminaire;

a second end cap disposed at the second end of the luminaire; and a rod that extends between the first end cap and the second end cap, that is fastened to the first end cap and the second end cap, and that extends through the first channel and the second channel.

9. The luminaire of claim 8, wherein the first channel comprises a first snap-in channel, and wherein the second channel comprises a second snap-in channel.

10. The luminaire of claim 5, further comprising:

a first end cap disposed at the first end of the luminaire;

a second end cap disposed at the second end of the luminaire; and a diffuser that comprises:

a first end disposed adjacent the first end cap; and a second end disposed adjacent the second end cap.

11. The luminaire of claim 10, further comprising a row of light emitting diodes extending lengthwise above the diffuser.

12. The luminaire of claim 11, wherein the row of light emitting diodes comprises a plurality of light emitting diode modules, and wherein the luminaire further comprises:

a hood disposed above and fastened to the first member and the second member, the hood providing an electrical enclosure; and a driver that is disposed in the electrical enclosure and that is electrically connected to the row of light emitting diodes.

13. An overhead luminaire comprising:

a frame that comprises:

a first end cap;

a second end cap;

an elongate cavity extending longitudinally between the first end cap and the second end cap;

a first bridge disposed adjacent the first end cap;

a second bridge disposed adjacent the second end cap;

a first rail extending at least between the first bridge and the second bridge;

a second rail extending at least between the first bridge and the second bridge; and a plurality of light emitting diodes disposed along an upper side of the elongate cavity; and a diffuser disposed along a lower side of the elongate cavity, wherein the first and second rails are aligned to the first and second bridges using a system of lengthwise extending grooves and lengthwise extending protrusions disposed in the lengthwise extending grooves, and wherein a plurality of fasteners fasten the first and second rails to the first and second bridges.

14. The overhead luminaire of claim 13, wherein the frame further comprises a rod comprising a first end fastened to the first end cap and a second end fastened to the second end cap, wherein the first bridge comprises a first channel, wherein the second bridge comprises a second channel, and wherein the rod extends through the first channel and the second channel.

15. The overhead luminaire of claim 13, wherein the frame further comprises an electrical housing disposed above the cavity, wherein the overhead luminaire further comprises at least one light emitting diode driver that is disposed in the electrical housing and that is electrically connected to the plurality of light emitting diodes, and wherein an upper side of the electrical housing comprises a port sized for coupling an electrical supply line to the at least one light emitting diode driver.

16. The overhead luminaire of claim 13, further comprising a diffuser that comprises:

a lower portion through which illumination exits the cavity;

a first side portion that comprises a first protrusion that extends lengthwise along the elongate cavity; and a second side portion that comprises a second protrusion that extends lengthwise along the elongate cavity;

wherein the first rail comprises a first groove that extends longitudinally and that faces the elongate cavity, wherein the second rail comprises a second groove that extends longitudinally and that faces the elongate cavity, wherein the first protrusion is seated in the first groove, and wherein the second protrusion is seated in the second groove.

17. The overhead luminaire of claim 13, wherein the plurality of fasteners fasten the first and second rails to the first and second bridges adjacent the lengthwise extending grooves and lengthwise extending protrusions disposed in the lengthwise extending grooves.

18. The overhead luminaire of claim 13, wherein the first and second rails and the first and second bridges are selected from a system that comprises:

rails and bridges of multiple configurations that interlock with one another; and end caps that are compatible with the rails and the bridges, and wherein the end caps that are compatible comprise the first end cap and the second end cap.

* * * * *